United States Patent [19]

Rhodes

[11] Patent Number: 4,630,407

[45] Date of Patent: Dec. 23, 1986

[54] METHOD FOR FINISHING A THERMOPLASTIC COATING

[76] Inventor: Lynn R. Rhodes, 10706 231st St. SW., Edmonds, Wash. 98020

[21] Appl. No.: 846,466

[22] Filed: Mar. 28, 1986

Related U.S. Application Data

[63] Continuation of Ser. No. 614,484, May 29, 1984, abandoned.

[51] Int. Cl.[4] ..... B24B 7/20

[52] U.S. Cl. ..... 51/322; 51/80 A; 51/328; 15/49 R; 144/361; 427/368

[58] Field of Search ..... 51/74 R, 76 R, 78, 80 R, 51/80 A, 81 R, 322, 324, 326, 328, 334, 336; 15/21 D, 49 R, 98; 144/329, 361, 364, 380; 427/355, 368

[56] References Cited

U.S. PATENT DOCUMENTS

| | | | |
|---|---|---|---|
| 1,540,110 | 6/1925 | Dittmar . | |
| 1,609,889 | 12/1926 | Sherman . | |
| 1,860,664 | 5/1932 | Edgecumbe et al. . | |
| 2,341,161 | 2/1944 | Partee et al. . | |
| 2,467,194 | 4/1949 | Dewitt . | |
| 2,617,223 | 11/1952 | McElroy et al. . | |
| 2,710,417 | 6/1955 | Short . | |
| 2,898,616 | 8/1959 | Coover | 15/49 R |
| 2,908,590 | 10/1959 | Norris . | |
| 2,920,947 | 1/1960 | Burk et al. . | |
| 2,971,856 | 2/1961 | Lauring . | |
| 3,081,159 | 3/1963 | Brown . | |
| 3,522,342 | 7/1970 | Nungesser et al. . | |
| 3,605,347 | 9/1971 | Barry . | |
| 3,643,278 | 2/1972 | Harris et al. . | |
| 3,895,464 | 7/1975 | Kiser . | |
| 3,961,108 | 6/1976 | Rosner et al. . | |
| 3,969,090 | 7/1976 | Sasena et al. . | |
| 4,037,369 | 7/1977 | Campbell . | |
| 4,109,337 | 8/1978 | Hillman et al. | 15/21 D |
| 4,122,576 | 10/1978 | Bevington et al. | 15/49 R |
| 4,284,668 | 8/1981 | Nixon | 427/355 |
| 4,305,234 | 12/1981 | Pichelman . | |
| 4,323,099 | 4/1982 | Bost . | |
| 4,363,835 | 12/1982 | Hackett et al. | 427/355 |
| 4,390,564 | 6/1983 | Kimble . | |

FOREIGN PATENT DOCUMENTS

| | | |
|---|---|---|
| 1572804 | 8/1980 | United Kingdom . |

*Primary Examiner*—Robert P. Olszewski
*Attorney, Agent, or Firm*—Seed and Berry

[57] ABSTRACT

The finishing machine of the present invention includes a drive assembly for moving a coated object longitudinally across a base at a predetermined speed and a finishing assembly connected to the base to contact at least a portion of the coating as the object moves across the base to raise the temperature of the coating to about its thermoplastic range for a predetermined time and to finish the coating during that time to a desired uniform finish. The finishing assembly includes a revolving brush having nylon bristles impregnated with a suitable abrasive. For moldings, the brush is mounted to a frame which is adjustable above the base to vary the height of the brush above the base and its angle with respect to the base. Edge finishing brushes may also be included on the base for finishing edges of the object as it passes through the machine. The method and apparatus are suitable for small objects, such as moldings, or large objects, such as doors. Large objects float between horizontally spaced, vertical brushes for uniform application of pressure.

8 Claims, 10 Drawing Figures

METHOD FOR FINISHING A THERMOPLASTIC COATING

This application is a continuation of U.S. patent application Ser. No. 614,484, filed May 29, 1984, now abandoned under C.F.R. § 1.62.

DESCRIPTION

1. Technical Field

The present invention relates to a process and apparatus for treating a coated object to bring the coating to a final uniform finish. More particularly, the invention relates to a brushing method and apparatus which provide a premier finish on doors.

2. Background Art

Doors and other wooden pieces of trim are usually finished by hand. U.S. Pat. No. 4,390,564, however, describes a semicontinuous or continuous process for finishing doors, including the steps of staining, lacquering, drying, buffing, and stacking the doors. A very fine sandpaper or a carpet material contacts the doors to buff the finish. Automatic apparatus, however, are unsuitable if the doors are not entirely flat. The belt sanders often develop high and low spots in the finish, requiring recoating of the door prior to final hand buffing. Sometimes these automatic machines cut through the veneer exterior of the door.

3. Disclosure of Invention

A preferred finishing machine for treating coated objects, such as doors and moldings, to bring the surfaces to a uniform final finish uses a nylon-abrasive brush to contact the coating on the object in such a way as to raise the temperature of the coating to about the thermoplastic range of the coating for a predetermined time during which the natural action of the brush brings the coating to its final finish.

Generally, the door finishing machine simultaneously finishes the coating on the opposite faces of the door, and includes a frame having at least four elongated, cylindrical brushes positioned in spaced pairs. Each brush has a substantially vertical orientation, and the door passes on edge between the brushes. Each brush includes a plurality of nylon bristles of predetermined length wherein each bristle is impregnated with an abrasive, such as silicon carbide, to provide the brush with an abrasive rating of about 320 grit. Each brush is separated from its pair so that the bristles of a brush just touch the coating of the door when the brushes are at rest. The door is conveyed from a infeed station to an exit station in a path which passes between the brushes with the grain of the wood. The door is conveyed at a predetermined speed, and the brushes revolve at predetermined speeds in predetermined directions to provide the desired buffing action. The brushes raise the temperature of the coating to about its thermoplastic range (130°–140° F. for polymer based coating normally using a lacquer thinner solvent system) for a predetermined period of time. A suitable coating is manufactured by Guardsman chemical at its Seattle, Wash. location, offered as a buffing lacquer. Other industry standard lacquers which meet Architectural Woodworkers Institute or National Kitchen Cabinet Association specifications have also been satisfactorily used. During this time, the action of the bristles, sweeping on the surfaces of the door, causes the finish to reach its desired, uniform, constant gloss appearance. The bristles also break the surface of the finish and, cause the carrier of vehicle of the finish to evaporate the carrier more quickly. The cure time is shortened by up to about 20 hours and better bonding is achieved. As a result a better finished is achieved in shorter times such as 30 seconds as compared to conventional hand sanding techniques that require about 5 to 6 minutes.

Usually, the first pair of brushes revolve in the same rotational sense. The second pair of brushes revolve in opposed rotational senses and impose a force on the door opposite the direction of travel of the conveyor. The door floats between the pairs of brushes so that the pressure applied to either face is substantially equal. This floating aspect is a critical condition of the door finishing machine. This floating condition allows simultaneous finishing of opposite faces in one operation.

The molding finishing machine holds the molding, base, or other trim piece between the finishing brush and drive rollers which feed the piece through the machine. The brush revolves in the direction counter to the motion of the piece through the machine, and contacts the coating of the piece to raise its temperature, as already described, and to achieve the desired final finish. Preferably, the revolving brush is adjustable above the drive rollers to accommodate objects of different shape and different thickness, and to allow the degree of penetration or overlap of the brush against the object to be adjusted to achieve the finishing characteristics that are desired. In a preferred machine, both the frame and subframe which holds the brush are independently adjustable so that the frame may be set a predetermined distance from the fixed drive rollers and the brush may be independently adjusted with respect to the frame and the rollers. That is, if the object being treated is a tapered base or molding having a thickness of approximately ½ inch at its broader end, the frame may be adjusted upwardly to about ⅜ to ½ inch above the drive rollers, while the subframe holding the brush may be adjusted independently of the frame so that the brush is substantially parallel to the tapered surface of the object.

A preferred molding finishing machine includes a fixed base having spaced, motor-driven drive rollers journal mounted to the base to define a reference plane. The rollers are driven at a predetermined speed. A frame is connected to the base above the reference plane and includes spaced, hold-down idler rollers aligned with the drive rollers of the base and spaced above the reference plane a predetermined distance. A spring assembly is affixed to the frame to bias the frame downwardly against the base but to allow the frame to raise upwardly to receive an object between the idler and drive rollers for finishing. A subframe is connected to the frame above the reference plane. The subframe includes an adjustment assembly for adjusting a brush on the subframe with respect to the frame and base. At least one generally cylindrical brush is journal mounted transversely across the subframe to be positionable between the idler rollers of the frame. In this position, the cylindrical brush is able to contact the coating on the object passing through the machine when the object moves longitudinally across the base on the drive rollers. A motor/drive assembly is mounted on the subframe to drive the brush at a predetermined speed in a predetermined direction. Due to the contact of the brush with the coated object, the coating reaches its final, uniform finish. The brush preferably has nylon bristles made from Korafil-E TM -nylon fibers impregnated with silicon carbide abrasive to give an abrasive rating for the brush of about 320 grit. The object travels at about 28–30 ft/min. for smoothing a coated piece of wood; the ends of the bristles of the brush move at a surface speed of about 1800 ft/min in a direction opposing movement of the object across the base.

The machine usually includes edge finishing mechanisms which contact and finish the edges of the door or other wood piece being finished as it passes through the machine.

These and other novel features of the invention, including the method of its operation, will be better understood with reference to the drawings and description.

BEST MODE FOR CARRYING OUT THE INVENTION

While the invention will be described for finishing doors and moldings, the brush concept of this invention is applicable to finishing any coated object so long as the brush can be constructed to conform to the exterior shape of the object. Since pressure and relative brush speed are important, the brush concept performs best for substantially planar wooden objects, such as doors and moldings.

For purposes of this description, a door includes two planar faces having edges running longitudinally between the faces and ends running transversely. The faces and edges are usually finished and the ends are left rough.

1. The door finishing apparatus

Figure 1:
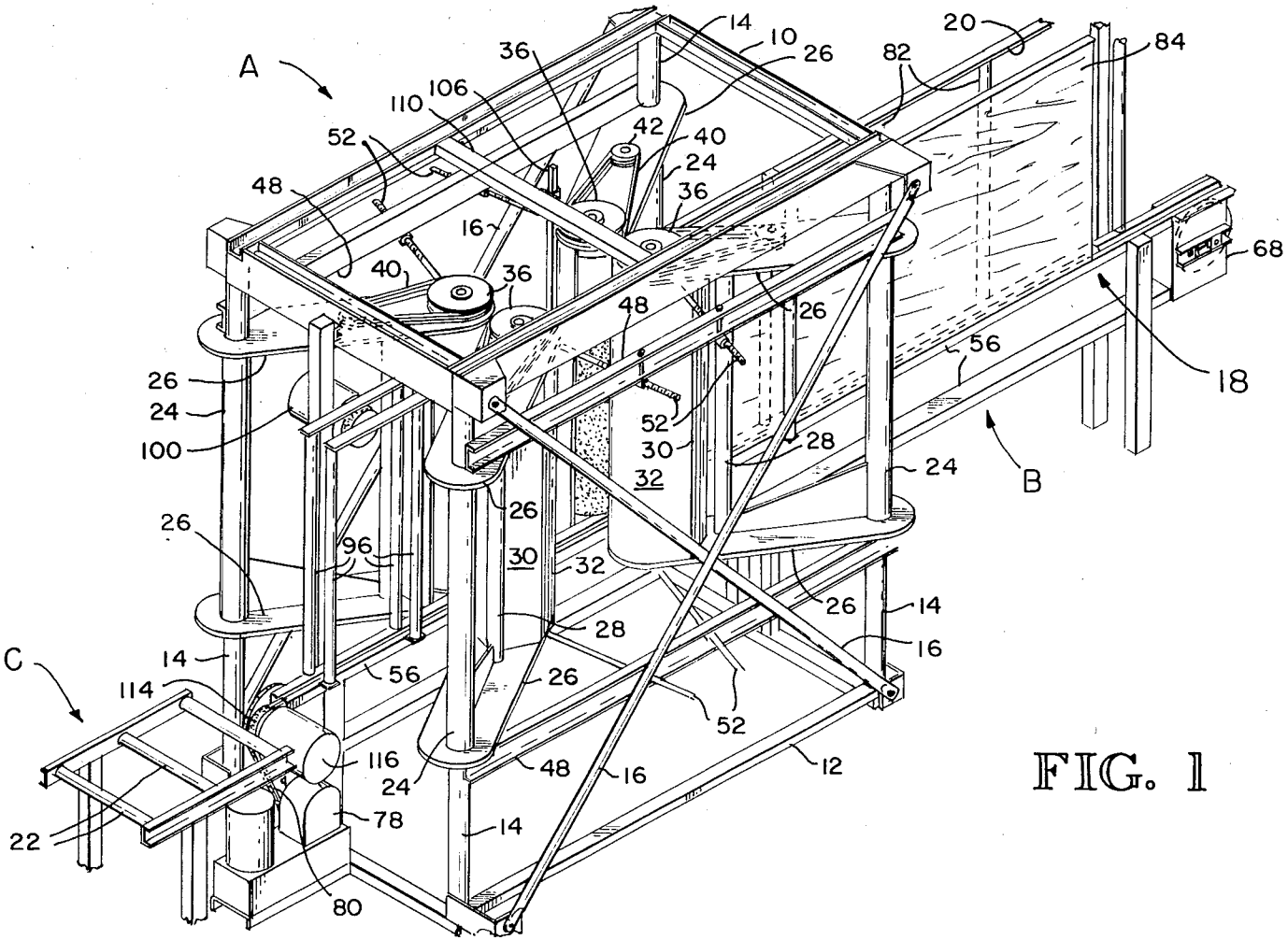
FIG. 1 is an isometric view of a preferred door finishing machine of the present invention.

Now referring to the drawings, as shown in FIG. 1, the preferred door finishing machine of the present invention includes a central frame A having an upper rectangular section 10 interconnected to a lower rectangular base section 12 with cylindrical uprights 14 positioned at the corners of the upper and lower sections. Diagonal cross-braces 16 may be used to further rigidify the frame A. A door infeed station B projects from one end of the central frame A and includes a conveyor 18 and a back framework 20 against which a door rests feeding into the machine. The infeed station is open on one side to allow a door to be positioned on the conveyor 18 so that the door may move into the frame A of the machine. This conveyor 18 will be described with greater specificity later in this description.

At the opposite end of the frame A, an exit station C includes a latticework of rollers for receiving the finished door as it exits the frame A. As shown, the exit station C is accessible from either side of the machine to allow stacking of the finished doors.

To operate the machine, an operator lifts a door and positions it on an edge in the infeed station of the machine on the conveyor. The conveyor then moves the door longitudinally into the frame A of the machine and through the finishing apparatus which will be described. The door proceeds at a constant speed through the machine and exits the frame at the exit station C. During its passage through the frame A, the door is contacted by finishing brushes which provide the desired final gloss and smoothness on the coated door.

Figure 2:
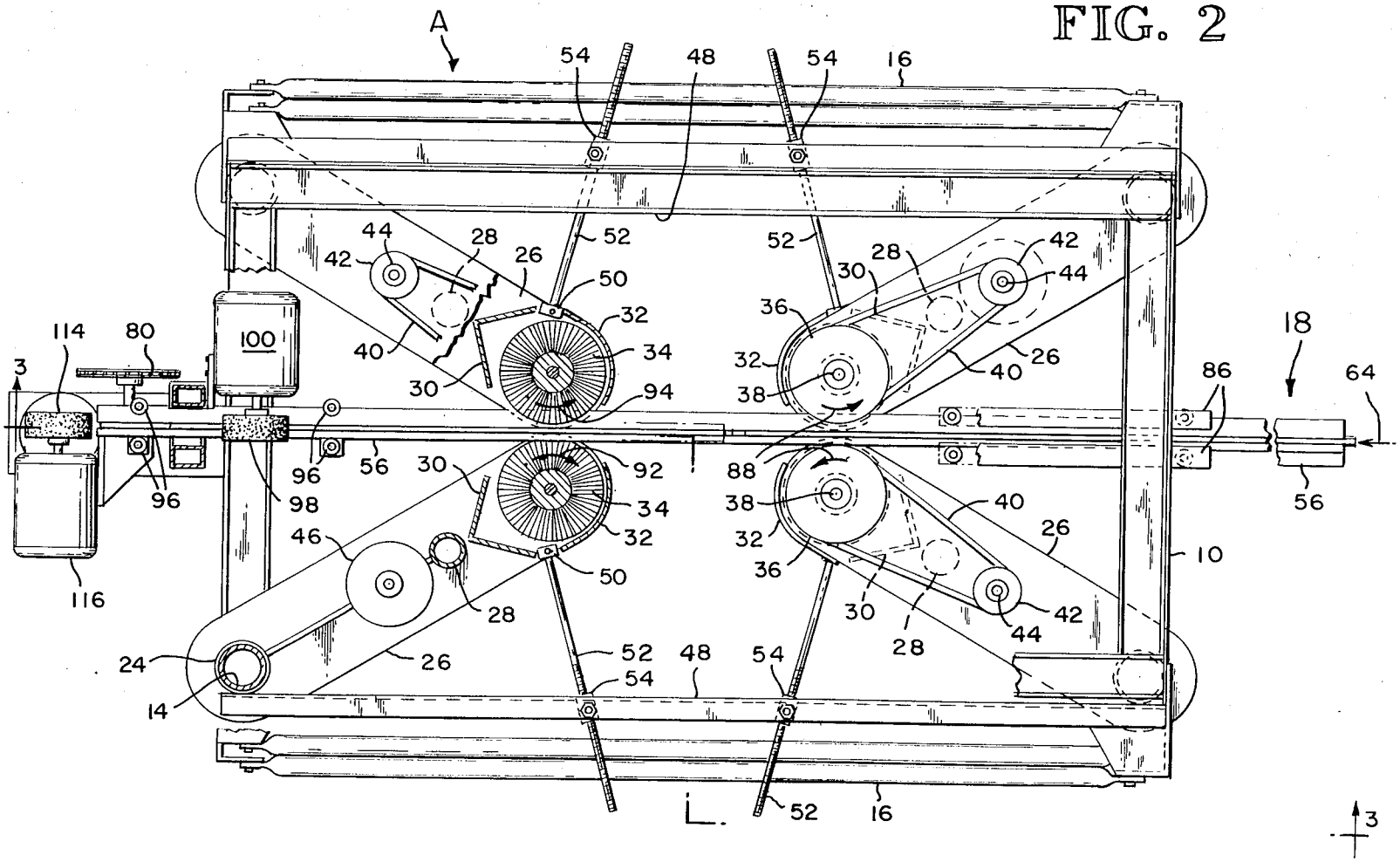
FIG. 2 is a top plan view of the machine of FIG. 1, partially in cut-away.

A sleeve 24 is rotatably mounted on each upright 14. Brush mounting arms 26 at the upper and lower ends of each sleeve 24 project inwardly to hold the door finishing brushes, as will be described. An intermediate support rod 28 interconnects support arms 26 immediately before a shroud 30 (FIG. 2). An additional shield 32 curls around a cylindrical brush 34 (FIG. 2) to contain the dispersion of material polished from the door during the finishing operation. Each brush 34 is journal mounted between the support arms 26 for free rotation and each is driven in a predetermined direction by a drive sprocket 36 connected to a stub shaft 38 extending upwardly from the brush through the upper support arm 26. A suitable drive belt 40 connects each drive sprocket 36 to a power sprocket 42 on the output shaft 44 for an independent electric motor 46 suspended beneath the upper support arm 26.

The brushes 34 are further rigidly positioned with a suitable tensioner alignment mechanism connected between the support arms 26 and longitudinal support members 48 extending between the uprights 14 above and below the sleeves 24. Each tensioner alignment mechanism includes a pivotable mounting 50 attached to a support arm 26 between the shroud 30 and shield 32. The mounting 50 allows minor variation in the angle assumed by a threaded shaft 52 which projects from its connection with the mounting 50 outwardly through a trunnion 54 (FIG. 2) mounted on the longitudinal support bars 48. Thus, when the threaded shaft 52 is turned, the support arm is forced slightly inwardly or outwardly to finely adjust the positioning of the brush 34. That is, the tensioner alignment mechanism can be used to achieve the substantial vertical orientation of the brush by exerting a racking force through the threaded shaft upon the respective arms. Furthermore, the tensioner alignment mechanism is used for adjustment of the spacing between the associated pairs of brushes. That is, the tensioner alignment mechanism may be used to move the entire brush mechanism inwardly or downwardly so that the brushes when stationary may be set to just contact the outer surfaces of the doors as the doors pass through the frame A. When the brushes are rotating at operational speed they will impose a frictional force on the door greater than the frictional force when the brushes were stationary. Substantially parallel arrangement of all brushes can be achieved with these mechanisms.

The sleeve 24, to which the arms 26 are welded, make up a rigid brush supporting frame. The brushes are journalled in this frame with the minimum possible tolerance. Adjustment of the vertical alignment of the brush 36 and its position relative to its opposed brush 34 is determined by the threaded shafts 52. As the pressures between the brushes and the door are so great only a slight oscillation of the brush can cut through the finish on the door. One-half-thousandth of an inch movement (0.0005 inch), for example, can cut through the finish. Thus, by rigidifying the brush support frame and adjusting the brush position by torsioning this frame, accurate positioning can be achieved in a very rigid manner to avoid independent brush oscillation or vibration.

All of the vertical guide rollers 86, 96 are loosely journaled and merely provide loose or rough guiding of the doors. The position of the door is controlled solely by the brushes to assure exactly equal uniform pressures between the brushes and the doors. The brushes' exterior profiles are cut or ground in after the brushes are assembled to assure an exact desired shape is provided since any variation in external profile of the brushes will result in excessive removal of coating or an undesirable wavy finish.

It should be reemphasized that the abrasively coated bristles are so dense and the pressure between the brushes and the door, over the four-foot width of the door, is so great that the door cannot be manually pushed through the brushes. Yet the brushes, by being accurately cut in external profile and rigidly mounted in the machine, can provide an abrading action on a wood coating which is so highly controllable and uniform over the face of a door that the millage removed by one pass through the machine is less than the 2–3 mils removed by conventional hand sanding. This provides the additional advantage of leaving more coating on the wood after one pass through the machine. Since more coating remains, the finish lasts longer and a conventional second coating is not needed. Hand sanding techniques by comparison require an additional time-consuming, expensive additional finish coat after the sanding.

The accurate profiling of the periphery of bristles, rigid mounting of the brushes, and floating freedom of conveyance through the brushes are critical to this invention. It appears that three things are occurring:

The coating gets heated by the friction and flows into a perfectly smooth surface. The effect is that grain nap is not present visually or to touch and the surface film is smooth. This elimination of grain nap and production of a smooth finish with a constant controllable gloss and premier appearance is a principal advantageous result.

The second and third effects are interrelated. The solvents carrying the resins in the coating must evaporate before a coating totally cures. Generally, a surface film will solidify, but the inner portion of the coating beneath will remain soft for a long period. With this invention, the bristles break the surface film and simultaneously heat the coating. The heat accelerates the evaporation of the trapped solvents while the broken surface allows release of the heated solvents. Since the flowing effect of the brush then smooths the broken surface, the finish remains smooth but the drying of the coating has been greatly accelerated.

Some range of variations in the technique is possible. It is known that for Korafil-E TM brushes, the relative tangential speed between the bristles and door is important, the pressure between the bristles and door is important, and the uniformity of that pressure over a large surface like a door is important. These parameters can be adjusted for a the particular coating specification until the coating barely reaches a flowable thermoplastic state. If too much heating occurs, the coating becomes too fluid and balls up. A preferred coating successfully tested is Guardsman Buffing Lacquer described above.

While door finishing is described, other coated wood products can be finished with this technique. Furthermore, the profile of the bristles can be contoured to match deeply contoured wood parts to be finished.

Alternative finishing techniques are available. One technique is to first run the wood through the machine for pre-smoothing prior to coating. After coating and drying, the coated wood is run through the machine again. One reason for pre-sanding is to close the pores of the unfinished veneers prior to coating to reduce variations in coating absorption into the wood from use of heartwoods and sapwoods often used in veneers or other wood products.

A preferred technique is to take the presmoothed wood and merely add the finish coat or coats, then after drying pass the coated wood through the machine. Even with one coat and no pre-sanding or pre-smoothing, a better finish is obtained with more mills of coating on the door than two-coat finishes with intermediate hand sanding between coats. For a premier finish superior to conventional hand sanded, two-coating techniques, a second coat can be applied after a first coat and the double-coated wood then passed through the machine.

The infeed station B has a conveyor 18 including two channel members 56 disposed to receive a continuous chain-link belt 58 (FIG. 3) which runs along the channel 56. At the infeed station B, the endless belt 56 passes around an adjustable sheath 62 (FIG. 3) which is used to remove slack from the belt by sliding the sheath 62 longitudinally along line 64 (FIG. 3) in a slot 66 formed in the corresponding face plates 68 which interconnect the upper and lower channels 56.

Figure 3:
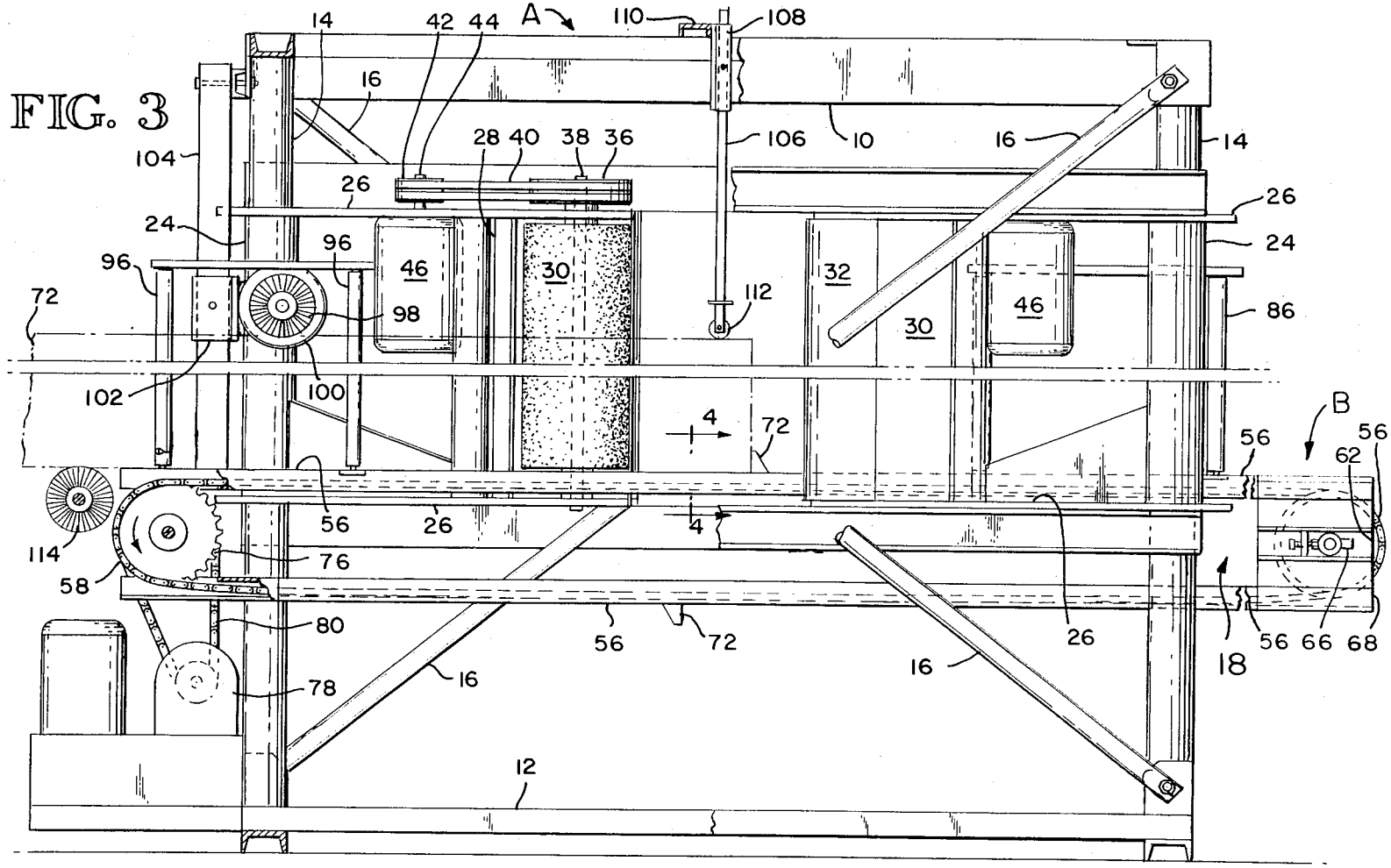
FIG. 3 is a side elevational view of the machine of FIG. 1, taken along line 3—3 of FIG. 2.
Figure 4:
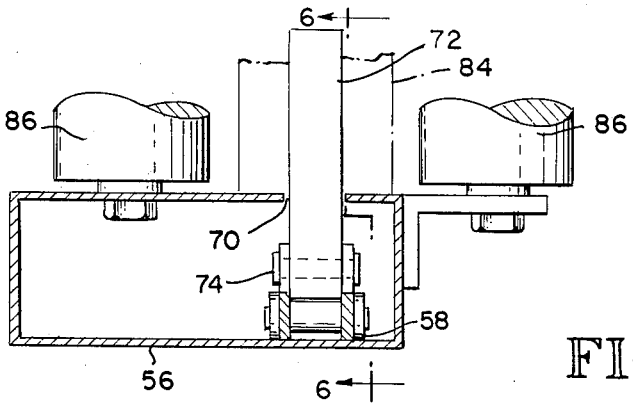
FIG. 4 is a sectional view taken along line 4—4 of FIG. 3.
Figure 5:
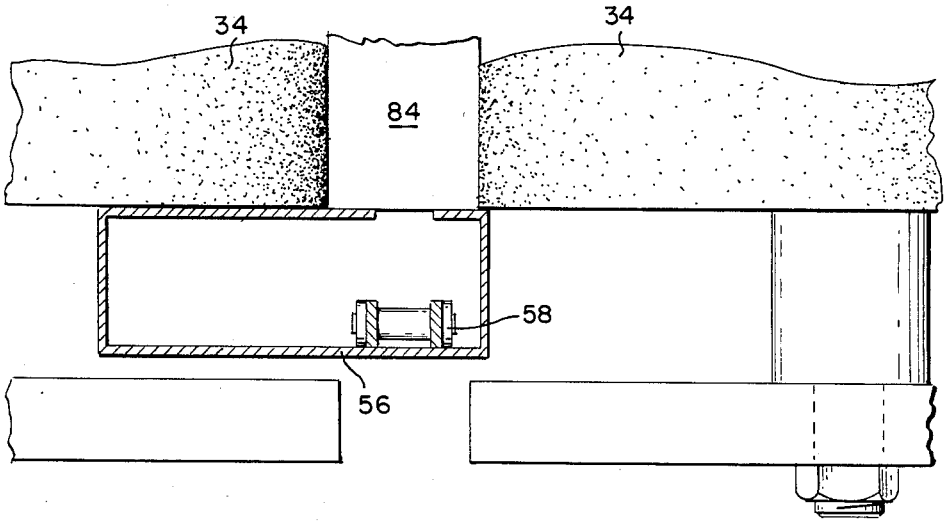
FIG. 5 is a detailed view similar to FIG. 4.
Figure 6:
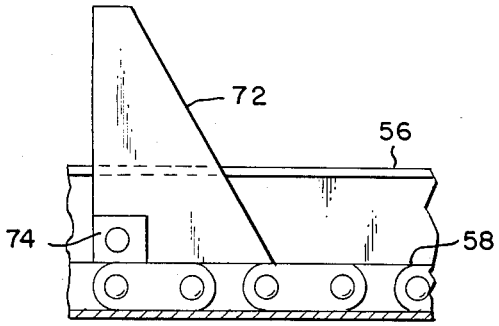
FIG. 6 is a side elevational view taken along line 6—6 of FIG. 4.

As shown in FIG. 4, each channel 56 has an offset slot 70 through which a lug 72 projects from the chain 58. As shown in FIG. 6, the lug 72 preferably is pivotally connected to the belt 58 through a hinge mechanism 74 connected to a link of the chain. At the exit station C, the endless belt 58 passes around a powered sheath 76 (FIG. 3) driven by a variable speed electric motor 78 through a connecting belt 80. The electric motor 78 moves the endless belt at a substantially constant speed so that the conveyor 18 will move a door through the machine at a relatively constant rate. Generally, the conveyor speed is approximately in the range of between about 12–16 (preferably 15) ft/min for smoothing the coated surface and about 20–25 (preferably 22) ft/min for the pre smoothing of bare wood surface.

The supporting framework 20 of the infeed station B includes a plurality of spaced rollers 82 (FIG. 1) which allow the door 84 to be supported on an edge in a substantially vertical orientation. Then, as the chain 58 is driven around its sprockets, a lug 72 engages an end of the door 84 (as shown in FIG. 4) and moves the door along line 64 above the channel 56 and into the machine. A centralizing guide mechanism 86 (FIG. 2) is mounted on the channel 56 to receive the leading end of the door and to guide entry of the door into the machine. It is critical that the pressure applied to opposite faces of the door be essentially equal to achieve the desired finish. Therefore, it is important that the door float between the brushes unimpaired. The centralizing guide mechanism 86 ensures that the door is substantially equally positioned to enter the center of the space between the pairs of brushes, which are transversely spaced on opposite sides of the channel 56. This centralizing guide mechanism only loosely holds the door between PVC rollers and is designed solely to position the center of the door essentially along the center line 64, as shown in FIG. 2.

The chain 58 moves the door into the machine between the first pair of brushes 34. These brushes 34 are revolving in a clockwise direction, as shown by arrows 88 in FIG. 2. The nylon-abrasive-impregnated bristles of each brush 34 are set to just contact the outside coated finish of opposed faces of the door when the door moves through the machine. Each brush revolves at a predetermined speed in the range of about 660–720 (preferably 690) rpm. The brushes raise the temperature of the coating on the opposed faces of the door to approximately 120°–140° F., the thermoplastic range for the coating system used. (The surface speed of each bristle is about 1800 ft/min.) If the temperature generated becomes too high, the coating melts and it is removed by the brushes. If the temperature is too low, the desired finish is not obtained. Door speed, brush speed, and pressure must be adjusted to achieve the desired result.

Each 10 inch diameter brush 34 has a plurality of 1.5 inch long, 0.0025 inch diameter, nylon bristles wherein each bristle is impregnated with a suitable abrasive, such as silicon carbide, to give the brush an overall abrasive grit size rating of about 320 grit. The bristles are preferably Korafil-E TM nylon available from the DuPont Company. They are attached to a central core to form a constant pack filled brush and the external peripheral profile is cut after the bristles are attached to the core. Brushes of this type are specially made by the Osborne Brush Company. Other brushes or bristle types do not successfully heat the finish to the desired temperature, and, therefore, may not work in the process of the present invention. In particular, brushes made by tampico or brushes using Scotch-Brite TM or only nylon bristles without abrasive have been tested unsuccessfully. Sandpaper strips formed as brushes or wheels also are unsatisfactory.

As shown in FIG. 4, the bristles of the brushes 34 just contact the opposed faces of the door 84 when the door moves along the conveyor from the infeed station B to the exit station C. The bristles lap against the outside coating of the door along the entire width of the door under a relatively constant force of 85–95 lbs. and at a controlled speed.

As the door proceeds along the conveyor 18, the leading edge of the door will enter a second pair of brushes 34, spaced downstream about two feet from the first pair. These second brushes are also transversely spaced so that the bristles of the brushes just contact the outside surfaces of the door as it moves along the conveyor. Unlike the brushes of the first pair, these brushes rotate in opposite rotational senses. That is, one brush rotates in a clockwise rotational sense, as indicated by arrow 92 (FIG. 2), while the other brush rotates in a counterclockwise direction, as indicated by arrow 94. This second pair of brushes continues the finishing action. Each brush is substantially identical to those already described. The combination of brushes raises the temperature of the lacquer system to its thermoplastic range for a predetermined period of time set by the speed of conveying the door through the machine. During this period when the lacquer system is thermoplastic, the bristles heat and smooth the lacquer to achieve the desired uniform finish for the door. For a period of time, the door simultaneously contacts the brushes of both pairs.

As the leading edge continues through the frame A, the door will engage exit guide mechanism 96, which, again includes spaced PVC rollers which loosely support the door on the chain belt 58 in a substantially vertical position. As with the infeed centralizing guide mechanism 86, this exit guide 96 does not interfere with the floating action of the door through the brushes. The floating action is a critical feature of the invention insofar as it ensures that the pressure on opposite faces of the door is essentially equal so that the finishing quality of either face is substantially identical.

As best shown in FIGS. 2 and 3, as the door 72 approaches the exit station C, the edges of the door encounter brushes which allow finishing of these edges during a single pass of the door through the machine. The upper coating brush 98 is powered by a suitable electric motor 100 to revolve at a predetermined speed suitable for raising the temperature of the lacquer coating system to its thermoplastic range, as previously described. The top edge finishing brush 98 is rigidly attached to a slidable 102 (FIG. 3) which moves upwardly and downwardly on vertical upright 104. The position of the sleeve 102 is preset before doors enter the machine for finishing. The shaft 106 for a hold-down roller 112 is adjustably positionable in a sleeve 108 mounted on transverse support beam 110 of the upper frame section 10 of the main frame A. A roller 112 (FIG. 3) rolls along the top edge of the door 82 when the door moves through the machine to help maintain the door in its substantially vertical orientation. This hold-down roller 112 does not significantly interfere with the floating action of the door through the pairs of brushes. As with the top edge finishing brush, this hold-down roller 112 may be preset at a predetermined height prior to operating the machine.

A bottom edge finishing brush 114 FIG. 3) driven by corresponding electric motor 116 engages the bottom edge of the door 72 as the door leaves the end of channel 56 and finishes this edge as the door passes from the frame A to the exit station C. The bristles of the bottom edge finshing brush 114 are set at a height just equal to the height at which the conveyor 118 moves the door along line 64. Thus, as with the face finishing brushes on the main frame of the machine, these top and bottom finishing brushes just contact the coating on the door to achieve the desired finish.

In operation, then, the door finishing machine of the present invention uses a plurality of brushes to achieve the desired finish. As the door moves in a predetermined direction at a predetermined speed, the outer coating is engaged by a revolving bristled brush in such a way that the coating is heated until it reaches its thermoplastic range. While still at this temperature, the bristles redistribute the coating to achieve the premier uniform finish desired for doors. Usually, two pairs of brushes are used to finish the faces of the door. The pairs are separated a small distance apart along the direction of travel of the door and the brushes of each pair are separated transversely so that the bristles of each brush just contact the outer surfaces of the door when the brushes are at rest. Revolving in predetermined directions at predetermined speeds, the brushes impart a desired force on the coating to raise its temperature to achieve the premier finish.

2. The door finishing method

An uncoated door may be sent through the machine so that the brushes may prepare the faces and edges of the door for finishing. In a preferred embodiment, a coated door with no pre-run through the brushes may be satisfactory. One or more coats of standard lacquer or a poly lacquer system is sprayed upon the edges and faces and allowed to dry for a predetermined time. Then, the door is passed through the machine travelling with the grain so that the brushes contact the finish and smooth the door coating to its predetermined uniform finish. The preparation step, if one is used, and finishing steps usually are done at different speeds. Of course, the initial surface preparation of the door may be handled in another way.

The method preferably comprises passing large wood objects, such as doors, between vertically oriented, horizontally spaced brushes having bristles made from nylon impregnated with silicon carbide abrasive. Preferably, each bristle is about 1½ inches in length on a brush about 10 inches in diameter, and about 1,150 bristles per square axial inch of brush are packed on the brush. The brush provides an abrasive rating of about 320 grit.

Thus the wood is coated, dried and then passed between the vertical, horizontally spaced brushes at a relative tangential speed between bristles and wood-coated surface of between 12 to 16 ft. per min. The wood is unrestrained against horizontal movement at it passes between the brushes to float and be guided horizontally solely by the brushes. The brushes are pressed uniformly along their lengths against the coated wood at a force of between 85 and 95 lbs. until the coating reaches a flowable thermoplastic state sufficient to flatten any bristle-formed indentations in the coating but not flowable to the point of melting where coating would be carried away by the bristles.

One successful operation using one coat of about 3–5 mil thickness of Guardsman Buffing Lacquer on oak veneer plywood produced a surface finish of about 3–5 mils thickness with a smoothness rating of industry Premium. The door was passed through the sets of brushes as shown in FIG. 2. The bristles were 1½ long. The spacing between the periphery of stationary opposed brushes was 1¾ inches for the door thickness of 1¾ inches. The peripheral tip speed of the downstream brushes which were rotated in opposite directions as shown in FIG. 2 was 1,800 fpm. The peripheral tip speed of one forward brush was 1,800 fpm in the counterclockwise direction, as viewed in FIG. 2. The opposite forward brush also was rotated counterclockwise at a peripheral tip speed of 1,800 fpm. The speed of the door was 14 fpm. The rotation of one of the forward brushes in the same direction as the door helps to move the door through the machine.

3. The molding finishing apparatus

The finishing machine of the present invention is best shown in FIGS. 7–10 and has a sturdy base 210 made from angle iron. At a forward end of the base 210, a transverse channel member 212 includes a transverse slot 214 for holding a pair of edge-finishing brushes 216 by the output shafts of respective electrical motors 218. Each brusn 216 is adjustably positionable in the channel 212 along the slot 214 by a set screw 220 and mounting plate bracket 222 journaled about the shaft 224 of the motor 218. One brush 216 rotates in a clockwise direction, as indicated by arrow 226, while the other brush rotates in a counterclockwise direction, as indicated by arrow 228. When in use, the brushes 216 revolve at the motor speed of approximately 1200 rpm to engage the coating on the edges of a coated object, such as a molding, casing, base, sill or jamb, to finish the edges. Each edge brush 216 is generally 6 or 7 inches in diameter, with bristles 1½ inches in length and packed to a density of about 1,150 bristles per square inch along the length of the brush, of Korafil-E TM nylon bristles impregnated with silicon carbide to give an overall abrasive rating for the brush of 320 grit. The rotating brushes tend to push the object into the machine, and in so doing, bend and are swept over the finish, raising the temperature of the finish to its thermoplastic range. While the finish is thermoplastic, the bristles finish the object to a uniform, final finish. The edge brushes 216 are only used for relatively thick objects up to about 2½ inches in thickness. In other circumstances, the edge brushes may be fixed at their outer extremities and disengaged, or be removed entirely.

As the coated object 230 proceeds into the machine in the direction indicated by arrow 232, the uncoated undersurface of the object 230 engages the rubber-coated surface of a drive roller 234 journal mounted transversely across the base 210. This first drive roller 234 draws the object 230 into the machine along with a second drive roller 236 which is journal mounted transversely across the base 210 downstream from the inlet drive roller 234. The two drive rollers 234 and 236 are both rubber coated with a coating of approximately ¼ inch thick having a durometer hardness as low as 20. The coating allows frictional engagement of the drive roller with the lower surface of the object and ensures that the object will be conveyed through the machine at a relatively constant speed. The two spaced drive rollers 234 and 236 are driven at a speed of approximately 28 ft/min by a belt 238 (FIG. 10) reaved round the rollers 34 and 36 and powered from a drive sheave 240 keyed to the output shaft 242 of an electric motor 246. The motor 246 is housed within a suitable dust cover 248 on the base.

A frame 250 overlies the base 210 and includes a forward transverse member 252 and a rearward transverse member 254 connecting the opposed side members of frame 250. Two idler rollers 256 and 258 are journal mounted across the frame 250 to overlie the drive rollers 34 and 36, respectively, as shown in FIG. 13. The idler rollers can engage the drive rollers or may be spaced a predetermined distance above the drive rollers.

The frame 250 is adjustably positionable above the base 210 by four adjustment bolts 260 at the corners of the frame 250. Each bolt 260 passes through a bore in the frame and engages a mated, threaded inner portion of a nut 262 affixed to an angle iron 264 (FIG. 10) mounted to the base 210. The threaded bolt 260 can be screwed upwardly and downwardly, as desired, to adjust the tension of an adjustment spring 266 encircling each bolt 260 to vary the pressure at which the frame 250 will rise when an object enters the machine. The spacing of the frame 250 above the base 210 may be controlled by the size of the nuts 262 or by spacer washers 268 (FIG. 10) placed around the bolt above the nut 262. Usually, the frame 250 is adjusted so that the idler rollers 256 and 258 will just engage the top surface of the object passing through the machine. In this way, the idler rollers provide a positive pressure to the object so that they positively engage the drive rollers 234 and 236 and are driven at a relatively constant speed through the machine.

The frame 250 includes a subframe 270 pivotally mounted transverse member 254 through a suitable hinge 272. An electric drive motor 274 is bolted to the subframe 270 above the hinge 272 to better balance the subframe 270. The hinge 272 allows the subframe 270 to be pivoted upwardly to allow access to the finishing brush 276 of the machine.

The finishing brush 276 is journal mounted across the subframe 270 in suitable yokes 278 and is driven counter to the drive rollers, as shown by arrow 280, through a sheave 282 (FIG. 9) mounted on the output shaft 284 of the brush 276. The sheave 282 is turned by a belt 286 which engages the drive sheave 288 on the output shaft 290 of a motor 274. The brush revolves at a relatively constant speed of approximately 3,600 ft/min in a direction opposing movement of the object through the machine on the drive rollers 234 and 236.

The forward end of the subframe 270 includes two adjustment spring assemblies at opposite edges of the subframe 270. Each adjustment assembly includes a threaded bolt 292 which passes through a bore in the subframe and engages a nut 297 (FIG. 10) pinned to the cross-frame member 252 of the frame 250. A spring 296 encircles the bolt 292 between the underside of the subframe 270 and the nut 294 or member 252 to bias the forward end of the subframe 270 upwardly from the frame 250. The bolt 292 may be turned in the nut 294 to vary the spring tension at the forward end of the subframe 270 and to consequently vary the relative position of the brush 276 with respect to the frame 250. That is, one of the bolts 292 may be threaded downwardly so that the brush assumes an angled orientation with respect to the frame and consequently with respect to the base. In this way, the machine can be set for treating and finishing tapered articles. For example, the frame 250 may be preset about ⅜ to ½ inch above the drive rollers 34 and 36, while the brush 276 may be adjusted to an angle so that the bristles of the brush are in relative constant engagement across a tapered object passing through the machine. That is, one bolt 292 may be screwed downwardly more than the other to compensate for the taper of the object so that the brush is angled above the frame 250.

The brush 276 includes Korafil-E TM nylon bristles impregnated with silicon carbide, providing an overall brush abrasive rating of about 320 grit. Each brush 276 is approximately 6 or 7 inches in diameter and has bristles of about 1½ inch length and about 0.050 inch diameter. The bristles are packed about 1,150 bristles per square inch. These bristles sweep over the coating of the object 230 and raise the temperature of the coating to its thermoplastic range for a predetermined time. During this time, the bristles affect the coating so that the desired uniform, final smooth finish is achieved. It is common practice to set the force of the brush against the object at about 85–95 lbs and to maintain this force during finishing operations.

A single cylindrical brush may be used to finish objects of varying shapes so long as the object's contours do not vary more than ¼ of an inch. If the brush would overlap with the object greater than this amount, it is necessary to provide a matched contoured brush. Otherwise, the brush will tend to destroy the finish.

While shown with reference to passing a single object 230 through the machine, it is passing to feed multiple objects side-by-side through the machine at the same time and thereby greatly increase the speed and efficiency of finishingg small trim items, such as molding, casing, and base.

Figure 9:
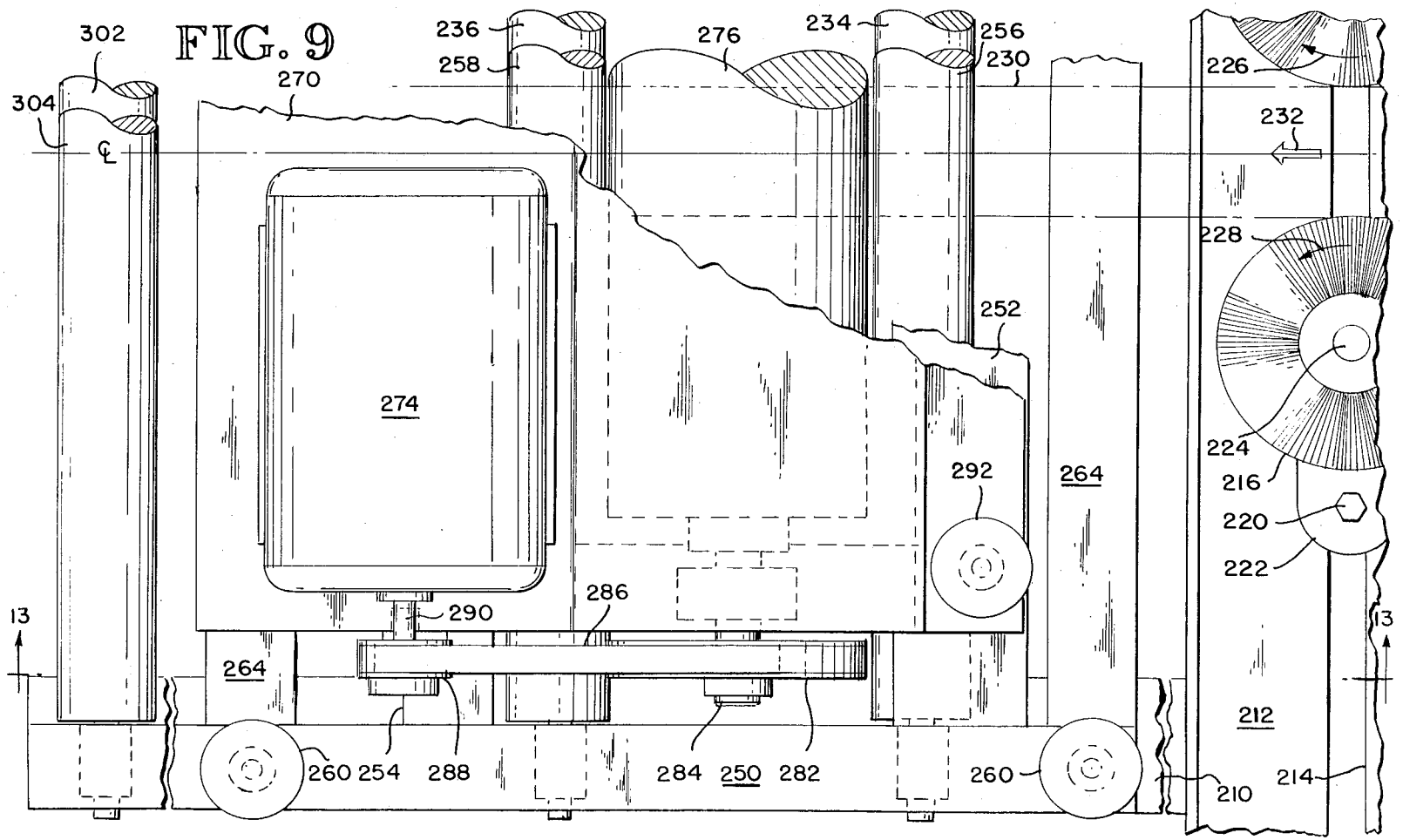
FIG. 9 is a partial plan view of the machine of FIG. 7.
Figure 10:
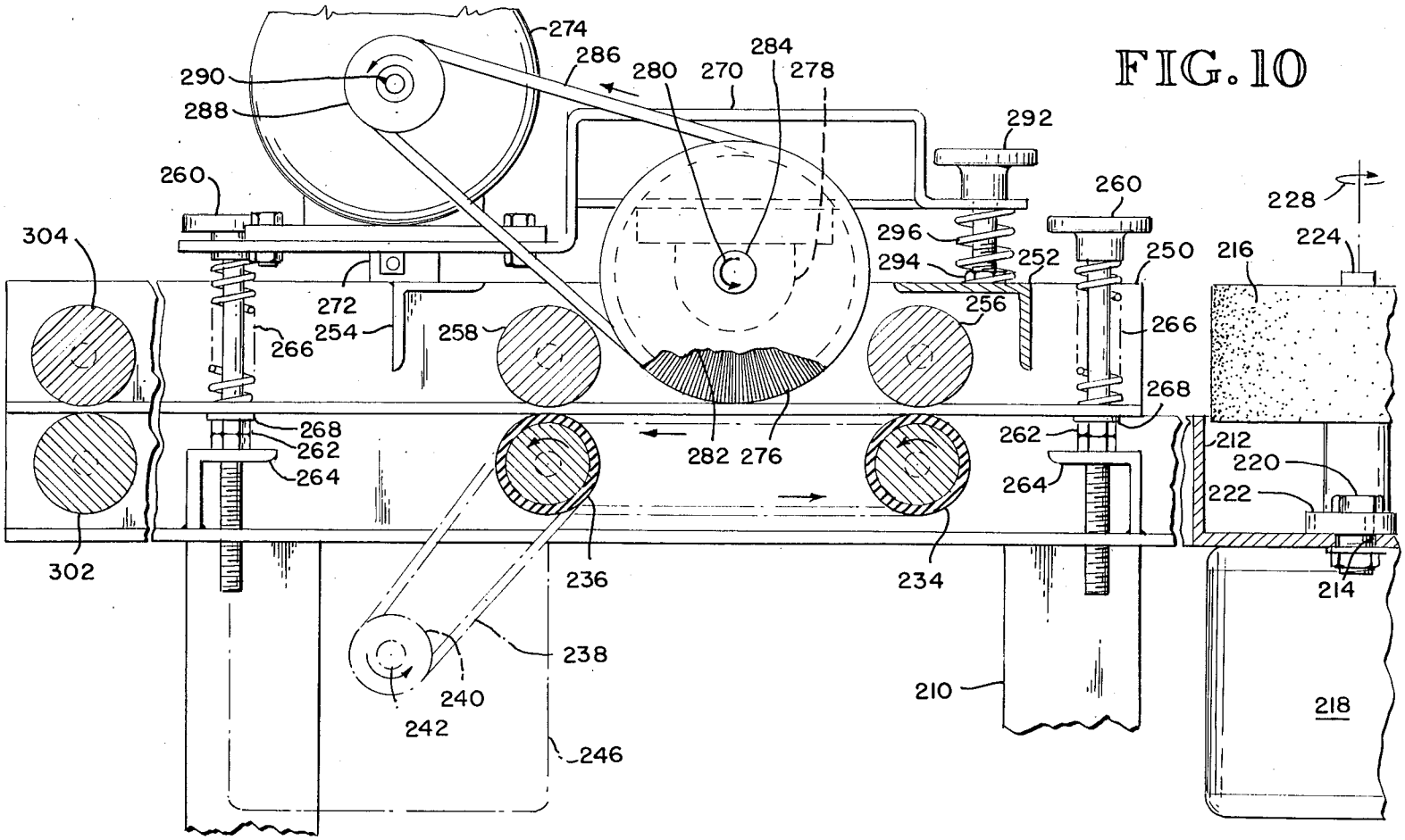
FIG. 10 is a partial sectional detail of the machine of FIG. 7 taken generally along line 10—10 of FIG. 9.

An inlet idler roller 298 is usually mounted across the base 210 before the channel 212. A second idler roller 300 (FIG. 7) is usually journal mounted transversely across the base 210 immediately before the first drive roller 234. A pair of idler rollers 302 and 304 are journal mounted transversely across the base and frame, respectively, at the downstream end of the machine, as shown in FIGS. 9 and 10. These downstream idler rollers 302 and 304 maintain a pressure on the object 230 as it passes through the machine. Other combinations of rollers may be used as desired.

Figure 7:
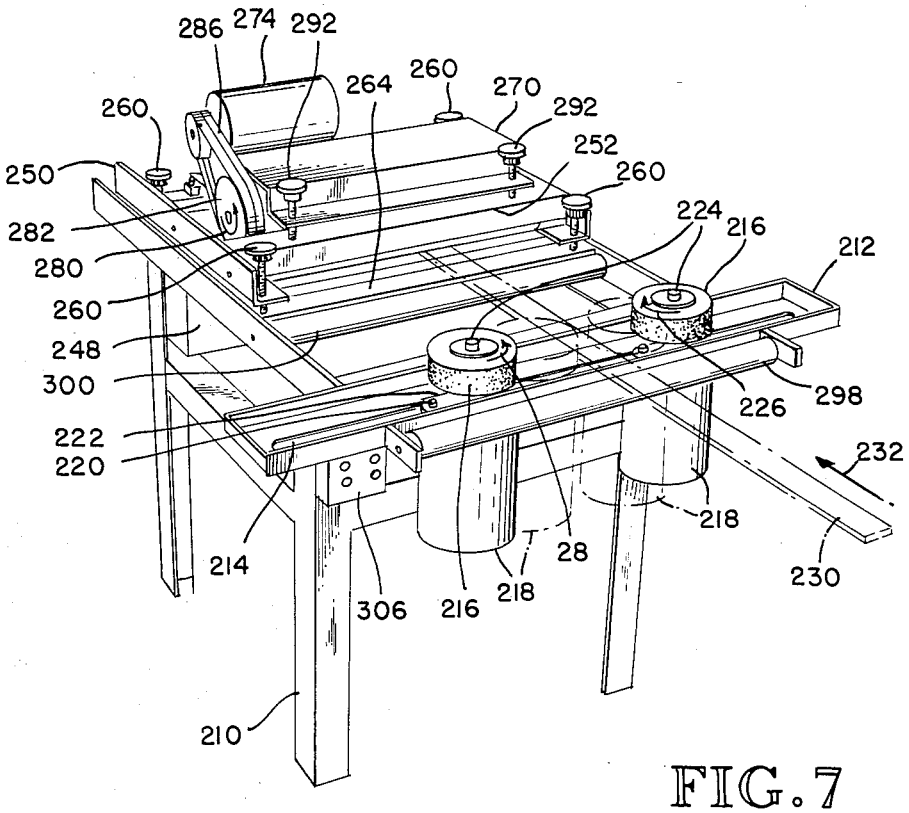
FIG. 7 is an isometric view of a preferred finishing machine of the present invention.
Figure 8:
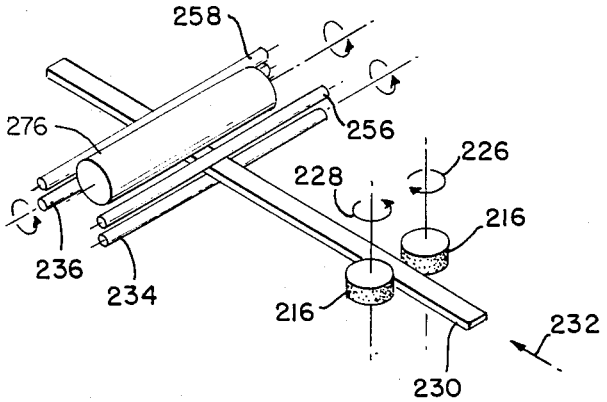
FIG. 8 is an isolated working detail of the mechanical system of the present invention.

As shown in FIG. 7, the base includes an electrical switch box 306 for controlling the rollers and brush 276. The edge brushes 216 are separately powered by an electrical outlet and switch (not shown) also mounted on the base 210.

4. The molding finishing method

The method and general principles of the invention of the molding apparatus are the same as for doors except that the objects passed through the brushes are smoothed only on one side rather than allowed to float through opposed brushes in the larger door finishing apparatus. Essentially, the method of finishing smaller objects, such as molding, is to pass the objects past a rotating brush having silicon carbide-impregnated nylon bristles. The brush should press against the object with a uniform force of between 85–95 lbs with a relative speed between the bristle tangential speed and the object speed between 1,700 and 1,850 fpm, preferably about 1,800 fpm. The speeds and forces may vary dependent on the specifications of the finish applied. Preferably, the bristles are Korafil-E TM with about 320 grit. The forces and speeds are regulated to heat the coating until it flows in a thermoplastic state sufficient to produce a smooth, nap-free finish. Preferably, the bristles will perforate the surface film also and heat and release solvents trapped beneath.

While preferred embodiments of the invention has been shown and described, those skilled in the art will recognize numerous modifications and variations which might be used without departing from the inventive concept of the invention. For example, those skilled in the art may recognize that the machine may be used to finish other objects coated on one side.

I claim:

1. A method for finishing a substantially thermoplastic coating on an object, said coating of the type that dries by solvent evaporation, said method comprising:

contacting the coating with an abrasive containing brush, said brush raising the temperature of the coating to just about its thermoplastic temperature, speeding evaporation of said coating solvents; and adjusting brush contact pressure and time to just that necessary to achieve said thermoplastic temperature of said coating such that said temperature is not substantially exceeded whereby the coating remains on said object but flows in response to said brush, during final solvent evaporation, and said coating solidifies to the final, uniform, smooth finish.

2. The method of claim 1 wherein the brush has nylon bristles, each bristle being impregnated with an abrasive, the brush having an abrasive rating of 320 grit, said brush having a profile substantially identical to a surface of said object to be finished.

3. A method for simultaneously finishing a substantially thermoplastic coating of the type which dries by solvent evaporation, on both major faces of a wood door, comprising the steps of:

(a) moving said substantially vertically oriented coated wood door in a predetermined direction at a predetermined speed;

(b) engaging each face of the moving door with one of a first pair of revolving cylindrical brushes, each brush having nylon bristles impregnated with an abrasive, the brushes revolving in the same rotational direction at predetermined speeds; and (c) engaging each face of the door downstream of the first pair with a second pair of brushes, each brush having nylon bristles impregnated with an abrasive, the brushes of the second pair revolving at predetermined speeds in opposed rotational directions to impose a force to the door resisting its motion in the predetermined direction.

4. The method of claim 3 wherein each pair of brushes raises the temperature of the coating, speeding drying of the finish coating on each face of the door, to just about the thermoplastic temperature of the coating, whereby said coating remains adhered to the surface of said door but, during final solvent evaporation, said coating flows and is smoothed by said brushes, finally solidifying to a uniformly smooth finish.

5. A method of simultaneously finishing opposing faces of a workpiece product having on each face a substantially thermoplastic coating that dries substantially by means of solvent evaporation, comprising:

contacting each coated face of said workpiece with one of a pair of rotating vertically aligned brushes, said brushes spaced apart such that the brushes at rest just touch both faces to be finished;

moving said coated workpiece between said brushes, wherein said workpiece is vertically supported by said brushes which contact the surfaces to be finished; and adjusting the speed of rotation of said brushes, contact pressure and speed of the moving workpiece, heating said coating by friction of the brushes to just the thermoplastic temperature of the coating, said coating in response to said brushes remaining in a softened flowable state, but adhered as a film to said workpiece, until said solvents have substantially completely evaporated and said coating solidifies into a smooth, nap-free finish on said workpiece.

6. The method of claim 5 wherein said brushes comprise nylon bristles impregnated with an abrasive material.

7. The method of claim 6 wherein the brushes are made from Korafil-E TM bristles.

8. The method of claim 5, including the step of engaging the produce twice at spaced locations along the path with bristles at said relative speed and force.

* * * * *